US005409595A

United States Patent [19]

Harandi et al.

[11] Patent Number: 5,409,595

[45] Date of Patent: Apr. 25, 1995

[54] HEAVY NAPHTHA CONVERSION

[75] Inventors: Mohsen N. Harandi, Langhorne, Pa.; Roger A. Morrison, Lambertville, N.J.; Gerald J. Teitman, Vienna, Va.

[73] Assignee: Mobil Oil Corporation, Fairfax, Va.

[21] Appl. No.: 223,064

[22] Filed: Apr. 4, 1994

Related U.S. Application Data

[63] Continuation-in-part of Ser. No. 106,689, Aug. 16, 1993.

[51] Int. Cl.[6] ..... C10G 69/10; C10G 35/06; C07C 5/32

[52] U.S. Cl. ..... 208/60; 208/58; 208/138; 208/141; 585/653; 585/655; 585/319; 585/322; 585/419

[58] Field of Search ..... 208/58, 59, 60, 62, 208/63, 64, 65, 69, 70, 134, 135, 138, 139, 141; 585/319, 322, 653, 655, 419

[56] References Cited

U.S. PATENT DOCUMENTS 3,702,818 11/1972 Streed et al. .
3,759,821 9/1973 Brennan et al. ..... 208/93
3,793,192 2/1974 Gladrow et al. .
3,806,443 4/1974 Maziuk .
3,847,792 11/1974 Berger .
3,882,014 5/1975 Monday et al. ..... 208/134
3,923,641 12/1975 Morrison .
3,930,986 1/1976 Berger ..... 208/60
4,333,817 6/1982 O'Brien ..... 208/101
4,647,368 3/1987 McGuiness et al. .
4,764,266 8/1988 Chen et al. ..... 208/58
4,812,223 3/1989 Hickey, Jr. et al. .
4,839,027 6/1989 Absil et al. .
5,198,097 3/1993 Bogdan et al. ..... 208/79
5,200,059 4/1993 Bogdan et al. ..... 208/79

*Primary Examiner*—Asok Pal
*Assistant Examiner*—Bekir L. Yildirim
*Attorney, Agent, or Firm*—Alexander J. McKillop; Malcolm D. Keen; Jessica M. Sinnott

[57] ABSTRACT

Catalytically cracked naphthas containing $C_9+$ hydrocarbons are hydrocracked over a crystalline zeolite, typically, mildly steamed zeolite beta then subjected to reforming to achieve a gasoline product of reduced end boiling range and higher octane than the feed. A hydrogen stream from the reformer which contains a catalytic promoter, such as chlorine, is separated into a first stream and a second stream. The first stream is treated over a solid sorbent to remove the promoter and recycled promoter to the hydrocracking step while the untreated second hydrogen stream which contains promoter is recycled to the reformer.

20 Claims, 2 Drawing Sheets

HEAVY NAPHTHA CONVERSION

CROSS REFERENCE TO RELATED APPLICATIONS

This is a continuation-in-part of Ser. No. 08/106,689 filed on Aug. 16, 1993 which is incorporated herein by reference in its entirety.

FIELD OF THE INVENTION

This invention relates to a process for the selective conversion and rearrangement of petroleum hydrocarbons. In particular it relates to a method for treating high end boiling range naphthas to improve volatility, reduce $T_{90}$, increase refinery gasoline production in the reformer and increase the yield of butanes.

BACKGROUND OF THE INVENTION

The reforming of hydrocarbons is widely used to upgrade hydrocarbon fractions such as naphthas, gasoline and kerosene, by molecular rearrangement, in the presence of hydrogen and a suitable reforming catalyst, usually promoted with chlorine, to improve the anti-knock characteristics thereof. Hydrocarbon feedstreams upgraded by reforming ordinarily are composed of normal and branched paraffins, naphthenic hydrocarbons and even some aromatic hydrocarbons.

Recently, it has been reported that pollution can be reduced by lowering gasoline endpoint to result in a product endpoint where, in a standard ASTM distillation, 90 volume percent of the gasoline distills below about 270° F. to 350° F. ($T_{90}$). Based on this, there have been legislative proposals, particularly in areas of high pollution, to require gasoline to meet a maximum $T_{90}$ specification of 300° F. Meeting this $T_{90}$ permits only 10% of the hydrocarbons in gasoline to boil above 300° F. A significant boiling range conversion of heavy naphthas will be required to meet this goal.

U.S. Pat. No. 4,812,223 describes hydrocracking a $C_5$+ naphtha over a noble metal-containing zeolite beta naphtha hydrocracking catalyst. U.S. Pat. No. 3,923,641 discloses the hydrocracking of naphthas using zeolite beta. The reference further discloses that $C_5$ naphthas, and especially $C_7$ naphthas, may be selectively hydrocracked to yield a high isobutane-normal butane ratio by contacting the naphtha with zeolite beta within the temperature range of from about 400° to about 550° F. The disclosures are silent on the $C_9$+ conversion.

U.S. Pat. No. 3,702,818 discloses a hydrocracking process for heavy petroleum feeds utilizing a crystalline aluminosilicate.

U.S. Pat. No. 3,793,192 discloses a process wherein a hydrocarbon feed stream is first catalytically cracked in a cracking zone at high conversion levels and subsequently fractionated to obtain light, intermediate, and heavy fractions. The intermediate fraction is treated by reforming to obtain a high octane product. The reformed product is subsequently blended with the light and heavy fractions to obtain a high-octane gasoline.

U.S. Pat. No. 3,806,443 discloses a process for selective hydrocracking of hydrocarbon feed streams followed by reforming. The disclosure is concerned with contacting a relatively wide boiling range naphtha hydrocarbon ($C_5$ to 400° F.) under selective hydrocracking conditions suitable particularly for removing the relatively low boiling $C_5$ and $C_6$ normal paraffins and no more than a minor amount of $C_7$ paraffins by selective cracking. The hydrocracking catalyst is characterized as a type B catalyst, that is, a porous solid particulate material having a majority of its pores of a substantially uniform small diameter ranging between 4.5 and about 6.0 Angstrom units.

U.S. Pat. No. 4,647,368 discloses partial hydrocracking over zeolite beta, fractionation of the hydrocracked effluent into a $C_4$ hydrocarbon stream, a light straight run naphtha and a 200° F.+ stream followed by reforming of the lower octane 200° F.+ stream to achieve a higher quality product.

U.S. Pat. No. 3,847,792 discloses a combination process for making narrow boiling range high octane motor fuel by low severity hydrocracking over mordenite followed by catalytic reforming. The charge stock has an initial boiling range of 100° F. and an end boiling range of less than 450° F.

Although the above prior art proposes various processes for improving the lower octane naphtha fractions, difficulties have been encountered in the implementation.

A conventional reformer usually requires a promoter, usually chlorine, as a catalyst promoter. However, the promoter, which easily finds its way into the hydrogen effluent of the reformer presents a problem when reforming is combined with zeolite catalyzed hydrocracking. The materials used as catalyst promoters, like chlorine (in the form of hydrochloric acid) can be poisonous to the zeolite catalyst of the hydrocracker. Therefore, this hydrogen stream cannot be recycled to the hydrocracker and consequently it would appear to be sufficient to recycle the stream back to the reformer since the hydrogen requirements of the reformer are typically about 7:1 hydrogen to hydrocarbon ratio. However, the hydrogen requirements of the hydrocracker are not insignificant (about 2:1 to 1:1 hydrogen to hydrocarbon ratio) and it is inconvenient and expensive to bring fresh hydrogen (a costly refinery commodity) to this stage of the process.

SUMMARY OF THE INVENTION

The present process integrates naphtha hydrocracking with reforming in a manner which allows hydrogen recycle from the reformer without the problem of poisoning the hydrocracking catalyst.

This process is very suitable for making benzene, toluene and xylenes (BTX).

The present invention is directed to a process for upgrading a naphtha feedstock comprising the steps of:

(a) contacting a naphtha feedstock and a hydrogen stream which is substantially free of catalytic promoter, typically a halogen such as chlorine, in a hydrocracking zone with a crystalline zeolite having a silica to alumina ratio of about 3 to 200 and a constraint index of between about 0.5 to about 2 under conditions favorable to cracking hydrocarbons of 9 or more carbon atoms to achieve a hydrocracked product of lower end boiling range than the feedstock ($C_5$+$T_{90}$); and (b) catalytically reforming at least a portion of the resultant hydrocracked product in a reforming zone in the presence of hydrogen and a catalytic promoter to produce a reformed hydrocarbon product and a hydrogen stream which contains a catalytic promoter;

(c) separating the high octane reformed hydrocarbon product from the hydrogen stream which contains the promoter;

(d) separating the hydrogen stream which contains the promoter into a first stream and a second stream, the first hydrogen stream being supplied to the reforming zone; and (e) removing the promoter from the second hydrogen stream to produce the hydrogen stream which is substantially free of the promoter for the hydrocracking zone whereby the promoter of the first hydrogen stream facilitates the reactions of catalytic reforming zone while the second hydrogen stream which is substantially free of the promoter facilitates the reactions of the hydrocracking zone.

DETAILED DESCRIPTION OF THE INVENTION

FEED

Figure 1:
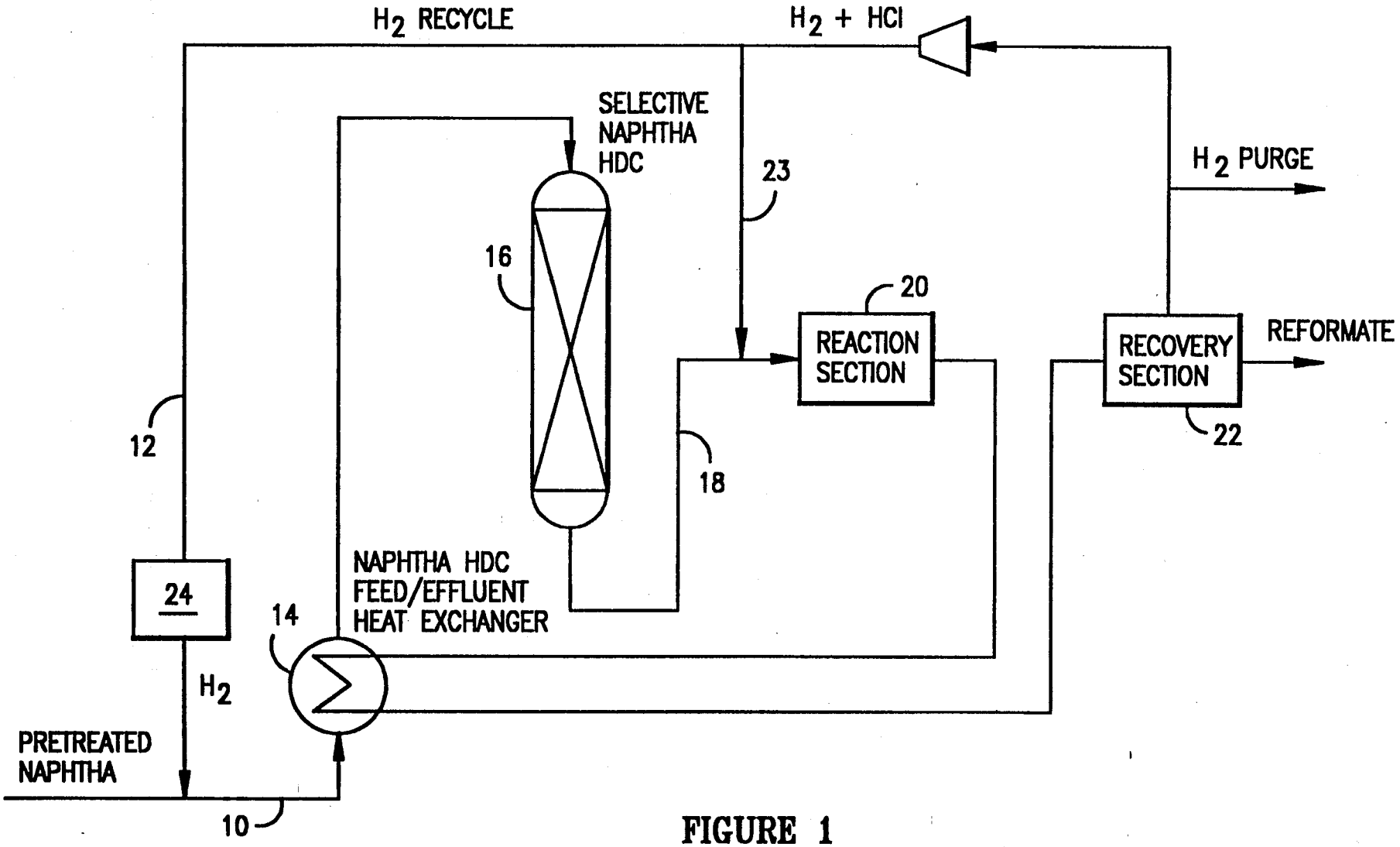
FIG. 1 is a simplified process flow diagram of an integrated hydrocracking-reforming process.

The feed to the process comprises a full range naphtha typically containing some naphtha boiling range components, characterized by a boiling range of $C_6$ to 450° F.

Sources of this feed include a straight run naphtha, hydrocracked naphtha, pretreated reformer feed, or catalytically cracked, i.e. TCC or FCC, heavy naphtha feed.

HYDROCRACKING

In the hydrocracking stage the hydrocarbons are subjected to reactions which produce a high yield of good quality gasoline. Typically, the reactions of the hydrocracker include cracking in the presence of hydrogen which results in materials of lower boiling range and higher octane number.

The zeolites useful herein for hydrocracking have an effective pore size such as to freely sorb normal hexane. In addition, the structure must provide constrained access to larger molecules. Rather than attempt to judge from crystal structure whether or not a zeolite possesses the necessary constrained access to molecules of larger cross-section than normal paraffins, a simple determination of the "Constraint Index" may be made. The determination of the Constraint Index is described in "Catalysis by Crystalline Aluminosilicates: Characterization of Intermediate Pore-Size Zeolites by the Constraint Index" 67 Journal of Catalysis p.p. 218–222 (1981). Constraint Index (CI) values for some typical materials are:

| | C.I, at 600° F. |
|---|---|
| ZSM-4 | 0.5 |
| ZSM-5 | 8.3 |
| ZSM-11 | 8.7 |
| ZSM-12 | 2 |
| ZSM-35 | 4.5 |
| ZSM-38 | 2 |
| TMA Offretite | 3.7 |
| Beta | 0.6 |
| H-Zeolon (mordenite) | 0.5 |
| REY | 0.4 |

-continued

| | C.I, at 600° F. |
|---|---|
| Amorphous Silica-Alumina | 0.6 |

The above-described Constraint Index is a useful way to define those zeolites which are useful in the instant invention. The very nature of this parameter and the recited technique by which it is determined, however, admit of the possibility that a given zeolite can be tested under somewhat different conditions and thereby exhibit different Constraint Indices. Constraint Index seems to vary somewhat with severity of operation (conversion) and the presence or absence of binders. Likewise, other variables such as crystal size of the zeolite, the presence of occluded contaminants, etc., may affect the Constraint Index. Thus, it should be understood that the Constraint Index value as used herein is an inclusive rather than an exclusive value. That is, a crystalline zeolite when identified by any combination of conditions within the testing definition set forth herein as having a Constraint Index in the range of 0.5 to 2 is intended to be included in the instant zeolite definition whether or not the same identical zeolite, when tested under other of the defined conditions, may give a Constraint Index value outside of the range of 0.5 to 2.

The class of zeolites usable in the process of this invention is exemplified by zeolite beta, ZSM-4, ZSM-12, ZSM-38 and other similar materials. Other contemplated zeolites include MCM-22, MCM-36, MCM-49, MCM-52 and MCM-56, Mordenite, faujasites, zeolite Y and X. Preferably the zeolites used have a silica to alumina ratio of between about 3 and about 100.

Zeolite beta is a zeolite of the composition:

$$[XNa\ (1.0+0.1-X)TEA]\ AlO_2.\ Y\ SiO_2.WH_2O$$

wherein X is less than 1, Y is greater than 5 but less than 100, W is up to about 4 and TEA represents tetraethylammonium ion. The composition of zeolite beta and its preparation are disclosed in U.S. Pat. No. 3,308,069, reissued Feb. 18, 1975, as RE 28,341 which reissue is incorporated herein by reference. The preferred zeolite beta catalyst for use with this invention is a mildly steamed noble metal containing zeolite beta as described in U.S. Pat. No. 4,812,223, which is incorporated herein by reference in its entirety.

ZSM-12 is described in U.S. Pat. No. 3,832,449. That description, and in particular the X-ray diffraction pattern disclosed therein, is incorporated herein by reference.

ZSM-38 is more particularly described in U.S. Pat. No. 4,046,859. The description of that zeolite, and particularly the specified X-ray diffraction pattern thereof, is incorporated herein by reference.

ZSM-4 zeolite is more particularly described in U.S. Pat. Nos. 3,578,723 and 3,716,596. The description of that zeolite and particularly the specified X-ray diffraction pattern thereof, is incorporated herein by reference.

It is to be understood that by incorporating by reference the foregoing patents to describe examples of specific members of the class with greater particularity, it is intended that identification of the disclosed crystalline zeolites be resolved on the basis of their respective X-ray diffraction patterns. As discussed above, the present invention contemplates utilization of such catalysts wherein the mole ratio of silica to alumina is essentially unbounded. The incorporation of the identified patents should therefore not be construed as limiting the disclosed crystalline zeolites to those having the specific silica-alumina mole ratios discussed therein, it now being known that such zeolites may be substantially aluminum-free and yet, having the same crystal structure as the disclosed materials, may be useful or even preferred in some applications. It is the crystal structure, as identified by the X-ray diffraction "fingerprint", which establishes the identity of the specific crystalline zeolite material.

The specific zeolites described, when prepared in the presence of organic cations, are substantially catalytically inactive, possibly because the intra-crystalline free space is occupied by organic cations from the forming solution. They may be activated by inventional techniques such as by heating and base exchange.

When synthesized in the alkali metal form, the zeolite is conveniently converted to the hydrogen form, generally by intermediate formation of the ammonium form as a result of ammonium ion exchange and calcination of the ammonium form to yield the hydrogen form. In addition to the hydrogen form, other forms of the zeolite wherein the original alkali metal has been reduced to less than about 1.5 percent by weight may be used. Thus, the original alkali metal of the zeolite may be replaced by ion exchange with other suitable metal cations of Groups I through VIII of the Periodic Table, including, by way of example, nickel, copper, zinc, palladium, calcium or rare earth metals.

It may be useful to incorporate the above-described crystalline zeolite with a matrix comprising another material resistant to the temperature and other conditions employed in the process. Such matrix material is useful as a binder and imparts greater resistance to the catalyst for the severe temperature, pressure and reactant feed stream velocity conditions encountered in many cracking processes.

Useful matrix materials include both synthetic and naturally occurring substances, as well as inorganic materials such as clay, silica and/or metal oxides. The latter may be either naturally occurring or in the form of gelatinous precipitates or gels including mixtures of silica and metal oxides. Naturally occurring clays which can be composited with the zeolite include those of the montmorillonite and kaolin families, which families include the sub-bentonites and the kaolins commonly known as Dixie, McNamee-Georgia and Florida clays or others in which the main mineral constituent is halloysite, kaolinite, dickite, nacrite or anauxite. Such clays can be used in the raw state as originally mined or initially subjected to calcination, acid treatment or chemical modification.

In addition to the foregoing materials, the zeolites employed herein may be composited with a porous matrix material, such as alumina, silica-alumina, silica-magnesia, silica-zirconia, silica-thoria, silica-beryllia, and silica-titania, as well as ternary compositions, such as silica-alumina-thoria, silica-alumina-zirconia, silica-alumina-magnesia and silica-magnesia-zirconia. The matrix may be in the form of a cogel. The relative proportions of zeolite component and inorganic oxide gel matrix, on an anhydrous basis, may vary widely with the zeolite content ranging from between about 1 to about 99 percent by weight and more usually in the range of about 5 to about 80 percent by weight of the dry composite.

The zeolite will usually contain a metal of Groups IVA, VA, VIA or VIIIA of the Periodic Table and such metal may either be in the cation of the zeolite or deposited on the surface of the zeolite. Preferred metals include platinum, palladium, zirconium, nickel, tungsten and molybdenum. A typical catalyst comprises Ni-W/zeolite beta, Zr-W/zeolite beta or Mo/zeolite beta.

The hydrocracking step in the process is operated at temperatures in the range of from about 400° F. to about 1000° F.; pressures from about atmospheric up to as high as 3000 psig but preferably between 100 and 600 psig; a liquid hourly space velocity (LHSV) in the range of from about 0.1 to about 500 and a hydrogen to hydrocarbon molar ratio selected from within the range of from about 1 to about 20.

In the processing scheme of this invention in which a 350° F.+ boiling range material is used as the feed, it is important to operate the hydrocracker at a relatively high conversion (e.g. at least 10% butane yield), otherwise the end boiling range of the reformate will be too high.

The hydrocracking reactor is usually a fixed bed reactor but moving bed and tubular reactors are also contemplated.

REFORMING

The operating conditions employed in the reforming operation are those conditions which promote dehydrogenation of naphthenes along with reactions associated with hydrocyclization, hydrocracking and isomerization and include typical operating temperatures selected from within the range of from about 800° F. to about 1000° F. and preferably from about 850° F. up to about 980° F., liquid hourly space velocity in the range of from about 0.1 to about 10, preferably from about 0.5 to about 5; a pressure in the range of from about atmospheric up to about 600 psig and preferably from about 100 to about 400 psig and a hydrogen to hydrocarbon molar ratio selected from within the range of from about 0.5 to about 20 and preferably from about 1 to 10. Usually the hydrocracking zone is operated at a pressure of about 2 to 30 psi higher than the top of the reformer reaction zone.

The reforming catalyst, selected for use in the sequence of process steps of this invention may be selected from any one of a number of known prior art reforming catalysts suitable for accomplishing the results desired. These catalysts include generally alumina as the carrier material for one or more hydrogenation-dehydrogenation components distributed thereon. The alumina carrier is promoted with, for example, one or more Group VIII metal components with an acidic promoter such as silica, boron or a halogen. The reforming catalyst is intended to include platinum, palladium, osmium, iridium, ruthenium or rhenium and/or mixtures thereof deposited on an alumina containing carrier or support with the alumina components generally being in an amount up to about 95% by weight. Other components such as magnesium, zirconium, thorium, vanadium and titanium may also be combined or distributed in the alumina carrier. The typical platinum type catalyst usually includes various amounts of halogen such as chlorine or fluorine. The platinum reforming catalysts described may be one of those described in the prior art as homogeneous mixtures of metal components, alloys, and metal halide complexes thereof. A bimetal catalyst composition suitable for the reforming operation of this invention may be platinum combined with either rhenium, ruthenium, osmium or iridium and an alumina carrier promoted with chlorine to provide the desired acid activity.

The reformer reaction section is typically a fixed bed. However, moving bed, tubular or fluid bed reactors are also contemplated.

Since the reformer requires heat, the reforming reaction section usually includes a feed preheater or other heat source. In cascade mode, the amount of heat supplied to the reformer will depend upon the hydrocracker reactor outlet temperature. Although the conditions of hydrocracking are compatible with the operating conditions of the reformer, the reformer temperature conditions are usually higher than that of hydrocracking. So either interstage heating may be employed or the temperature of the hydrocracking step can be raised, typically by raising the feed temperature, to supply the heat necessary for the reforming reactions.

FIG. 1 represents one embodiment of the invention. A desulfurized heavy naphtha boiling range material as described herein, e.g., boiling in the kerosene boiling range is introduced to the process via conduit 10 along with a hydrogen-rich and catalyst promoter deficient recycle gas introduced via line 12. The feed is introduced to heat exchanger 14. Heat exchanger 14 elevates the temperature of the feed to about 350° to 850° F. (177° to 454° C.), more specifically 400° to 600° F. (204° to 316° C.), a temperature sufficient to effect the selective hydrocracking reactions upon contact with the catalyst of reactor 16. Also contemplated is a process in which the hydrocracking zone comprises a plurality of distinct catalyst stages and reaction cooling stages. Reactor 16 can be a single bed reactor or it can comprise a plurality of (typically 3 to 4) distinct catalytic stages or zones (not shown). The catalyst zones are associated with cooling zones or stages which reduce the reaction temperature as the feed passes through the reactor to avoid overcracking. Quench systems, in which the unheated feed or other cool material is used as quench can be employed. Pump-around heat exchanges are also contemplated employing quench systems to control overcracking as in conventional hydrocrackers. This is disclosed in "Petroleum Refining for the Non-technical Person", p. 83. The heated feed is passed to reactor 16 which contains a hydrocracking catalyst of the kind described herein.

The conditions of reaction are maintained to achieve selective hydrocracking of the $C_9$+ components of the feed and isomerization. The effluent of the reactor 16 is then passed via conduit 18 to reformer 20. The hot effluent of the reformer can be used in heat exchange 14 for effective heat exchange with the feed. The effluent is then passed to product recovery section 22 which separates a hydrogen-rich gaseous product, via a conventional hydrogen recovery unit, for recycle to reactors 16 and 20 with removal of chlorine in sorbtion zone 24. Preferably more than 50% of the recycled hydrogen is directly sent to the reforming reaction section via conduit 23.

In one mode of operation the process is used to make BTX, a valuable refinery commodity. In this mode of operation, the hydrocracking severity is to a degree sufficient to crack $C_9$+ hydrocarbons to form $C_8$— hydrocarbons, under which conditions, the hydrocracker isomerizes $C_6$ to $C_8$ paraffins making them easier to aromatize in the reformer.

In one embodiment of the invention (not shown) the feed is passed through a fractionator prior to hydrocracking. The fractionator separates a $C_6$ to $C_8$ stream which bypasses the hydrocracker and passes directly to the reformer. Alternatively, a separate source of $C_6$ to $C_8$ hydrocarbons can be introduced to reformer 20.

Figure 2:
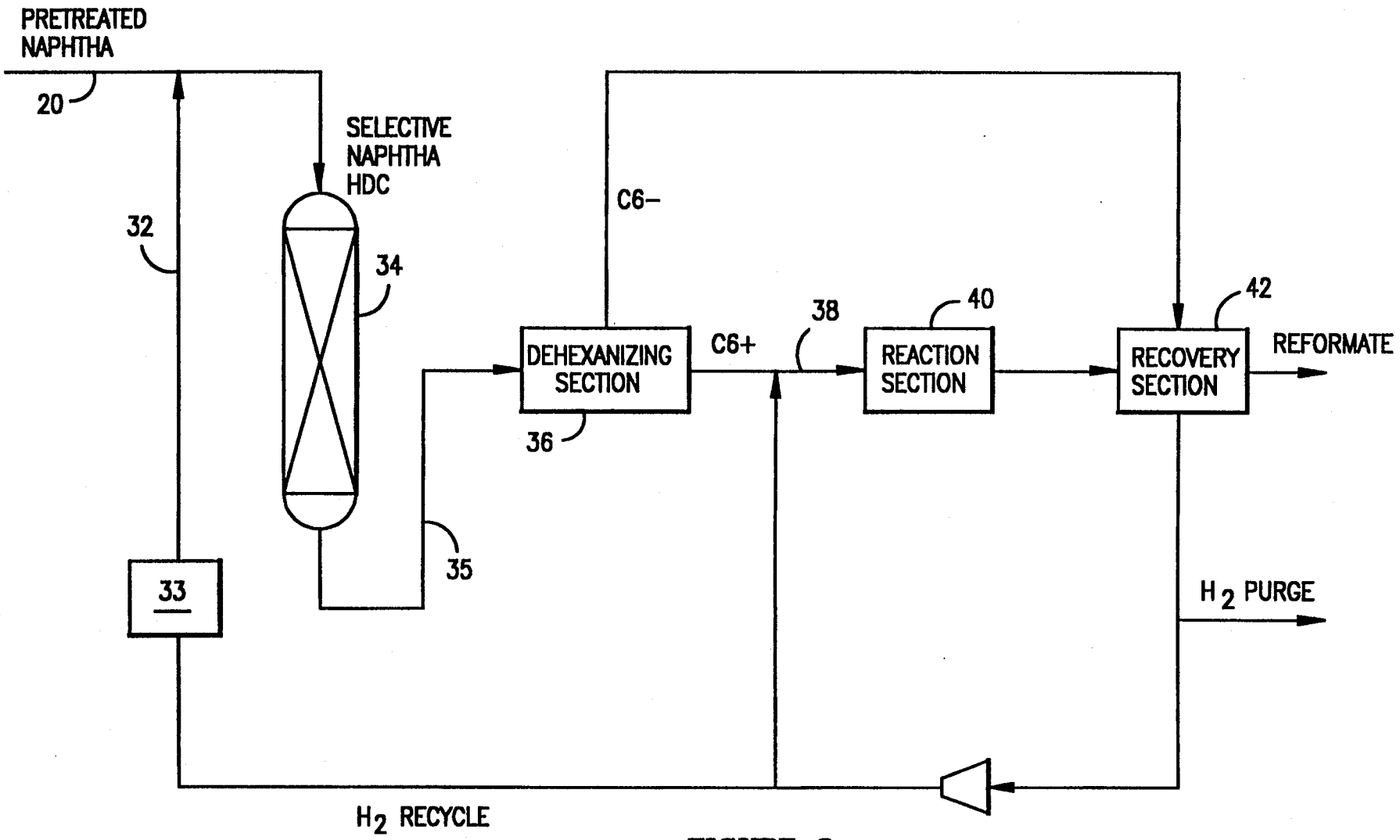
FIG. 2 is a simplified process flow diagram of one embodiment of the present invention.

FIG. 2 represents another embodiment of the invention which is useful when the feed to the hydrocracker is isoparaffinic to retain the isoparaffinic character of the feed. A desulfurized heavy naphtha is introduced to the process via conduit 30. Hydrogen, that is, a hydrogen-rich substantially promoter-free recycle gas withdrawn from promoter removal zone 33, is introduced by conduit 32 to the naphtha charge as it passes to reactor 34 which contains the selective hydrocracking catalyst. In this process scheme, the hydrocracker is operated at a temperature below 650° F. and about the same pressure as the reformer. The effluent of reactor 34 is passed to dehexanizer 36 via line 35 which removes $C_6$— hydrocarbons. A depentanizer and/or debutanizer (not shown) can also be employed to remove $C_5$— and $C_4$— hydrocarbons from the $C_6$— hydrocarbons. Since isoparaffins have a high octane rating, their separation is advantageous to avoid conversion to n-paraffins and benzenes in the reformer. The remaining effluent is passed by conduit 38 to reformer 40. The exotherm from the heat of reaction of the hydrocracking zone provides sufficient preheat for the reformer. The reformate is passed to recovery section 42 to separate hydrogen-rich gaseous products for recycle as described herein.

As mentioned above, the hydrogen stream from the reformer contains a catalytic promoter, typically a halogen material such as chlorine which is usually in the form of HCl. The catalytic promoter-containing hydrogen stream is separated into a first stream and a second stream. The first hydrogen stream which contains the catalytic promoter is fed to the reformer 20. The catalytic promoter-containing stream is passed through catalytic promoter sorbtion zone 33 to produce a substantially promoter-free hydrogen stream.

A benefit of the configuration of FIG. 2 is that the high octane isoparaffin $C_6$—, $C_5$— or $C_4$— components are not passed to the reformer reactor which converts them to less desirable n-paraffins or benzene.

A preferred method for removing the promoter is with a solid sorbent such as a metal oxide.

The promoter removal section is usually a fixed bed sorber located upstream of the reformer reaction section. The conditions for sorbing the promoter include temperatures, typically, ranging from 50° to 200° F., specifically 50° to 150° F., more specifically from 100° to 120° F. The pressure conditions are usually the same as the reformer. Metal oxide sorbents are, typically, alumina and alumina-containing materials such as amorphous silica-alumina and zeolites. Other metal-containing sorbents can be employed such as iron, calcium and magnesium.

After a period of time the catalyst promoter removal section becomes exhausted and requires regeneration. This is accomplished by desorption with a desorbing fluid, such as hydrogen, at desorption conditions which are usually temperatures typically ranging from 100° to 1000° F., specifically about 400° F.

The hydrocracking zone and the reforming zone can be located within a single reactor, in which case, the recycle hydrogen stream is split and recycle hydrogen containing promoter is introduced interstage and the remaining hydrogen is passed through the promoter sorbent to produce a promoter-free recycle stream appropriate for the hydrocracking zone. Thus, also contemplated is a process in which the hydrocracking zone and the reforming zone are contained within a single reactor.

What is claimed is:

1. A process for upgrading a $C_9+$ containing naphtha feedstock boiling above 350° F. comprising:

(a) contacting the $C_9+$ containing naphtha feedstock and a hydrogen stream, which is free of a reformer catalyst promoter, in a hydrocracking zone with a catalyst which is incompatible with reformer catalyst promoter, the catalyst comprising a crystalline zoolite having a silica to alumina ratio of about 3 to 200 and a constraint index of between about 0.5 to about 2 under conditions rarerable to cracking hydrocarbons of 9 or more carbon atoms to achieve a hydrocracked product of lower end boiling range than the feedstock;

(b) catalytically reforming at least a portion of the resultant hydrocracked product in a reforming zone in the presence of hydrogen and a reformer catalyst promoter to produce a reformed hydrocarbon product and a hydrogen stream which contains a catalytic promoter;

(c) separating the reformed product from the hydrogen stream which contains the reformer catalyst promoter;

(d) separating the hydrogen stream which contains the reformer catalyst promoter into a first stream and a second stream, the first hydrogen stream being supplied to the reforming zone; and (e) removing the reformer catalyst promoter from the second hydrogen stream to produce the hydrogen stream which is free of the reformer catalyst promoter and supplying the second hydrogen stream which is free of the reformer catalyst promoter to the hydrocracking zone.

2. The process of claim 1 in which the naphtha feedstock is a full range naphtha fraction boiling below 450° F.

3. The process of claim 1 in which the conditions of the hydrocracking zone include temperatures between about 400° F. and 1000° F. and pressures of about atmospheric to about 3000 psig.

4. The process of claim 1 in which the hydrocarbon product is characterized by a temperature at which 90% of the hydrocarbons boil of below 300° F.

5. The process of claim 1 in which the catalyst of the hydrocracking zone further comprises a metal cation selected from the group consisting of Groups IVA, VA, VIA, and VIIIA of the Periodic Table.

6. The process of claim 1 in which the catalyst of step (a) comprises zeolite beta, MCM-22, MCM-36, MCM-49, MCM-52, MCM-56, mordenite, zeolite Y or zeolite X.

7. The process of claim 6 in which the catalyst comprises a metal selected from the group consisting of platinum, palladium and nickel.

8. The process of claim 5 wherein said metal cation is selected from the group consisting of cobalt, molybdenum, nickel, tungsten and mixtures of two or more of these.

9. The process of claim 1 which further comprises the steps of separating a $C_6$—, $C_5$— or $C_4$— containing hydrocarbon fraction from the hydrocracked product and reforming the heavier hydrocarbons of the hydrocracked product.

10. The process of claim 1 in which the step of removing a catalytic promoter comprises a passing the hydrogen stream over a solid adsorbent selective for removing the promoter.

11. The process of claim 1 in which the steps of contacting in the hydrocracking zone of step (a) and catalytically reforming in the reforming zone of step (b) are conducted within a single reactor.

12. The process of claim 1 which further comprises introducing a source of fresh hydrogen to the reforming zone of step (b).

13. The process of claim 1 in which the hydrocracking zone is conducted under conditions of temperature and pressure sufficient to achieve a high conversion whereby the hydrocracked product comprises at least 10% butane.

14. The process of claim 6 in which the catalyst of step (a) comprises Ni-W/Zeolite beta or Mo/Zeolite beta.

15. The process of claim 1 in which the step of contacting in the hydrocracking zone is conducted over a plurality of distinct catalyst zones with interzone reaction cooling.

16. The process of claim 9 in which the hydrocracking zone is operated at a temperature below 650° F.

17. The process of claim 1 in which the catalytic promoter is removed from the hydrocarbon stream by passing it over an alumina-containing sorbent.

18. The process of claim 1 in which the step (e) of removing the reformer catalyst promoter includes the use of a sorber under temperatures ranging from 50° F. to 200° F.

19. The process of claim 18 in which the step (e) includes temperatures ranging from 50° F. to 150° F.

20. The process of claim 18 which further comprises the steps of (f) carrying out the reformer catalyst promoter removing step (e) until the sorbent becomes exhausted; and (g) regenerating the sorbent with hydrogen at desorption conditions of temperatures ranging from 100° to 1000° F.

* * * * *

UNITED STATES PATENT AND TRADEMARK OFFICE

CERTIFICATE OF CORRECTION

PATENT NO. : 5,409,595

DATED : April 25, 1995

INVENTOR(S) : Harandi et al.

It is certified that error appears in the above-indentified patent and that said Letters Patent is hereby corrected as shown below:

In Column 9, line 15, change "zoolite" to "zeolite"

In Column 9, line 17, change "rareable" to "favorable"

Signed and Sealed this

Twenty-second Day of August, 1995

*Attest:*

*Attesting Officer*

BRUCE LEHMAN

*Commissioner of Patents and Trademarks*